US006731247B2

(12) United States Patent
Apostolos

(10) Patent No.: US 6,731,247 B2
(45) Date of Patent: May 4, 2004

(54) METHOD AND APPARATUS FOR REDUCING THE LOW FREQUENCY CUT-OFF OF A WIDEBAND MEANDER LINE LOADED ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 10/123,787

(22) Filed: Apr. 16, 2002

(65) Prior Publication Data

US 2002/0175872 A1 Nov. 28, 2002

Related U.S. Application Data

(60) Provisional application No. 60/290,874, filed on May 14, 2001.

(51) Int. Cl.[7] ..... H01Q 1/24; H01Q 9/32

(52) U.S. Cl. ..... 343/749; 343/702; 343/846

(58) Field of Search ..... 343/700 MS, 702, 343/895, 749, 846

(56) References Cited

U.S. PATENT DOCUMENTS 5,867,126 A * 2/1999 Kawahata et al. ..... 343/702
6,501,437 B1 * 12/2002 Gyorko et al. ..... 343/895

* cited by examiner

*Primary Examiner*—Michael C. Wimer
(74) *Attorney, Agent, or Firm*—Daniel J. Long; Robert K. Tendler

(57) ABSTRACT

A wideband meander line loaded antenna is provided with a capacitive feed to lower the reactance of the meander line antenna such that at lower frequencies the antenna reactance goes negative to cancel out the reactance of the meander line and distributed capacitance. The resultant lowering of the low frequency cut-off for the antenna permits the antenna to be used, for instance, in cellular phone applications in which not only are the cellular frequencies accommodated by the antenna, but also PCS and GPS frequencies as well. With the capacitive, feed the low frequency cut-off is lowered by as much as 30% over standard meander line loaded antennas.

14 Claims, 2 Drawing Sheets

METHOD AND APPARATUS FOR REDUCING THE LOW FREQUENCY CUT-OFF OF A WIDEBAND MEANDER LINE LOADED ANTENNA

This application claims the benefit of Provisional Application No. 60/290,874, filed May 14, 2001.

FIELD OF INVENTION

This invention relates to wideband antennas and more particularly to a method and apparatus for lowering the low frequency cut-off of meander line loaded antennas.

BACKGROUND OF THE INVENTION

Meander line loaded antennas are described in U.S. Pat. No. 5,790,080 issued to John T. Apostolos on Aug. 4, 1998 and incorporated herein by reference. The purpose of the meander line is to increase the effective length of the antenna such that compact antennas may be designed for use for instance in cellular phones where the real estate for the antenna is limited.

With the decrease in size of wireless handsets, it is only with difficultly that one can design an antenna which will fit within the margins of the case of the wireless handset and still be usuable in dual or trimode phones which span the 830 MHz and the 1.7 and 1.9 Mz bands. Now that GPS receivers are sometimes included in wireless handsets it is important that the antenna also be able to receive the GPS frequency of 1.575 GHz.

As illustrated in U.S. Pat. No. 6,323,814 issued to John T. Apostolos on Nov. 27, 2001 and incorporated herein by reference, an improvement over Apostolos' original patent includes a wideband version in which the meander line loaded antenna has a wide instantaneous bandwidth. In this particular antenna the feed to the antenna is through a meander line coupled between the signal source and a plannar conductor extending orthogonally from the ground plane for the antenna. This configuration offers an instantaneous bandwidth of 7:1 and has been implemented in a so called quadrature arrangement in which there are two pairs of meander line antennas arranged in opposition. The opposed pairs are orthogonally arranged to enable circular polarization.

As described in this latter, patent, the meander line is connected in series between a signal source and a plannar top conductor which is spaced from the ground plane such that the signal from the meander line is directly connected to the top plate. The result for such a feed for the meander line loaded antenna is that the low frequency cut-off of the antenna is determined by the fact that the meander line loaded antenna reactance with a shorted meander line is positive at the lower frequencies, which when added to the meander line and distributed capacity reactance results in a high VSWR at frequencies, in one embodiment, below 860 megahertz, thus limiting its usefulness in the cellular band which is centered around 830 megahertz. It is noted that in this type of antenna the drive is fed through the meander line and then to the top plate. Moreover, a quadrature arrangement is possible with this meander line design and is desirable when the antenna is mounted to the roof of a truck cab because of the circular polanization provided by the quadrature design.

SUMMARY OF THE INVENTION

Rather than having the meander line connected in series with the feed for the top plate, in the subject invention the feed from the signal source is spaced from one end of the top conductor thus to provide a capacitive feed. In this case, the meander line runs from this capacitive feed point parallel to underside of the top plate where it is folded back and then is connected by a transmission line to the underlying ground plane. The result is the shifting of the low frequency cut-off by more than 20% over the direct feed wide bandwidth meander line loaded antenna described above.

The reason for the shifting of the low frequency cut-off is the fact that the meander line loaded antenna reactance with a shorted meander line goes negative at lower frequencies. This reactance is subtracted from the meander line and distributed capacitive reactance such that at the peak of the meander line and distributed capacitive reactance waveform the reactance at the peak is cancelled by the negative going meander line antenna reactance.

With cancelled reactance at the lower frequencies, the VSWR of the antenna is decreased so that the antenna is now able to operate approximately 20–30% lower in frequency than the direct feed meander line loaded antenna described in U.S. Pat. No. 6,323,814.

In order to provide such an antenna, a horizontal top plate is coupled to the ground plane plate through a slow wave meander line and a transmission line. Signals are coupled to and from the horizontal plate through a low impedance capacitive feed. The meander line is a so-called slow meander line which has one or more loops and is connected to the top plate along the edge at which the capacitive coupling exists. The capacitive feed, in one embodiment, includes a vertical plate having an edge which is parallel to and adjacent to one edge of the top plate, with a gap existing therebetween. The slow meander line as described in the above patent is one in which signals travel down it at speeds less than the speed of light due to the differing impedances in the line.

A cap may be attached to the top plate to extend over the capacitive gap and downwardly to increase capacitance between the vertical plate and the top plate at lower frequencies.

Mounting the antenna on a finite ground plate conductor generates currents in the conductor which enhance loop mode antenna radiation at low frequencies relative to antenna dimensions to provide a volumetrically efficient antenna suitable for cell phone applications. Also the low frequency cut-off is lowered due to the meander line running from the capacitive feed point of the antenna to the ground plane. Thus there is a series connection to ground through the meander line, or opposed to having a series connection through the meander line to the signal source as was the case in the prior direct connection design.

While the subject capacitively fed meander line loaded antenna is discussed in connection with its use in cell phone applications involving not only the cellular phone band of 830 megahertz but also the PCS bands of 1.7–1.9 gigerhertz, such a capacitance fed meander line antenna also has application in a variety of different antennas designed for wideband applications.

One such application is a both vertically and circularly polarized antenna to be mounted on trucks, with the circular polarization generated by a quad arrangement of elements. The application is for a combined GPS, PCS and cellular antenna which performs both a wireless communication function with its vertical polarization and acts to receive GPS satellite signals with its circular polarization.

It has thus been found that the capacitive feed along with the loading technique described above extends the low frequency capability of the meander line loaded antenna, thus to effectively increase its already wide bandwidth.

In summary, a wideband meander line loaded antenna is provided with a capacitive feed to lower the reactance of the meander line antenna such that at lower frequencies the antenna reactance goes negative to cancel out the reactance of the meander line and distributed capacitance, the resultant lowering of the low frequency cut-off for the antenna permiting the antenna to be used, for instance, in cellular phone applications in which not only are the cellular frequencies accommodated by the antenna, but also PCS and GPS frequencies as well. With the capacitive feed the low frequency cut-off is lowered by as much as 30% over standard meander line loaded antennas.

BRIEF DESCRIPTION OF THE DRAWINGS

These and other features of the subject invention will be better understood in conjunction with the Detailed Description in combination with the Drawings, of which.

DETAILED DESCRIPTION

Figure 1:
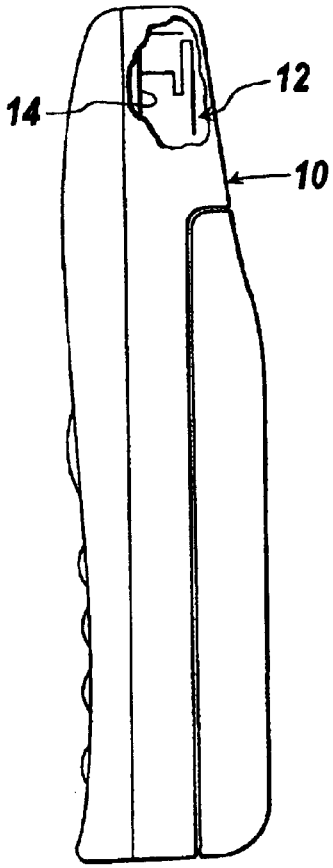
FIG. 1 is a diagrammatic illustration of a wireless handset with a low-frequency cut-off meander line loaded antenna.

Referring now to FIG. 1, a wireless handset 10 is provided with the subject antenna 12. This wideband antenna is contained in an upper compartment 14 of the handset and provides in one embodiment for trimode operation in both analog, digital cellular and PCS frequencies. It is important to be able to provide the wireless handset with a wide bandwidth antenna which covers all of the frequencies and bands that the handset is to transmit and receive on.

Figure 2:
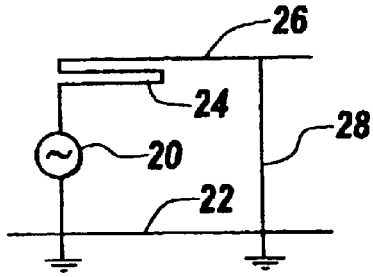
FIG. 2 is a diagrammatic representation of a prior art wideband meander line loaded antenna showing the connection of the signal source through the meander line to the top plate of the antenna.

Referring to FIG. 2, in the prior art in order to provide a wide bandwidth antenna, a loaded meander line antenna is provided in which a signal source 20 is coupled on one side to a ground plane 22 and through a meander line 24 to a top plate 26 which is parallel to ground plane 22. The loading in this case is provided by a transmission line 28 connected between top plate 26 and ground plane 22.

Figure 3:
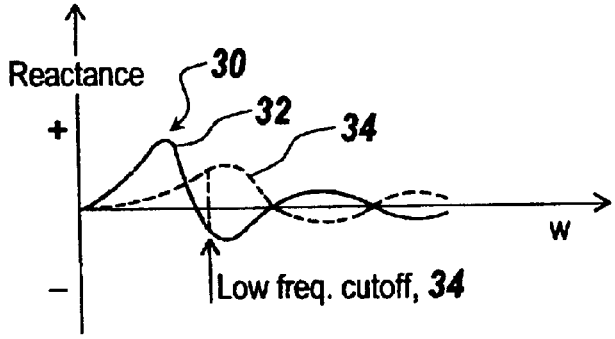
FIG. 3 is a graph showing the combined reactance of the antenna of FIG. 2 in which the reactance is additive at the lower frequencies thus raising the VSWR.

While the wide bandwidth meander line loaded antenna of FIG. 2 operates appropriately across a wide bandwidth, it's low-frequency cut-off, as can be seen from FIG. 3 is determined by several reactances.

As can be seen in FIG. 3, there is a reactance associated with the meander line plus the distributed capacity associated with the meander line which is shown by waveform 30. As can be seen waveform 30 has a peak 32 below a low-frequency cut-off point 34, illustrated by the corresponding arrow.

Also associated with the antenna of FIG. 2 is a meander line loaded antenna reactance illustrated by dotted waveform 34 which is the antenna reactance with a shorted meander line. As can be seen, above the low-frequency cut-off 32 there is cancellation of the two different reactances such that the standing wave ratio is close to 1 to 1 for frequencies above the low-frequency cut-off.

However, below the low-frequency cut-off it can be seen that the two reactances associated with waveforms 32 and 34 are additive, thus increasing the VSWR.

Figure 4:
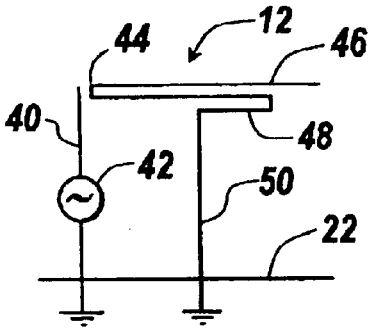
FIG. 4 is a diagrammatic representation of the subject capacitively feed meander line loaded antenna in which the signal source has an output which is capacitively feed to upper plate of the antenna, with the meander line extending from the edge of the upper plate to which the input signal is capacitively coupled and down the upper plate in folded spaced relationship thereto.

Referring now to FIG. 4, rather than feeding the meander line in series with the a top plate, in the subject invention a capacitive coupling is utilized in which a vertical plate 40 from a signal source 42, serves to couple the energy from the signal source 22 to an end 44 of top plate 46. It will be appreciated that a folded meander line 48 is electrically coupled to the edge of the plate at point 44 and is in turn shunted to ground through a transmission line 50 at the other end of the meander line.

Figure 5:
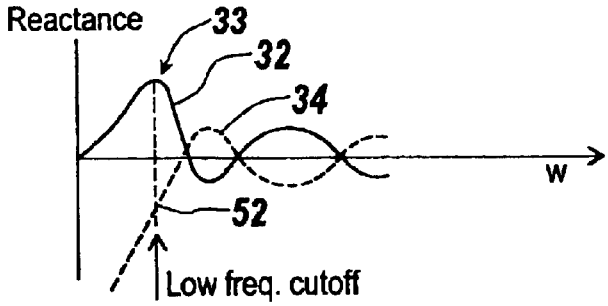
FIG. 5 is a graph showing the cancellation of the reactances for the antenna of FIG. 4 which lowers the cut-off frequency of the antenna.
Figure 6:
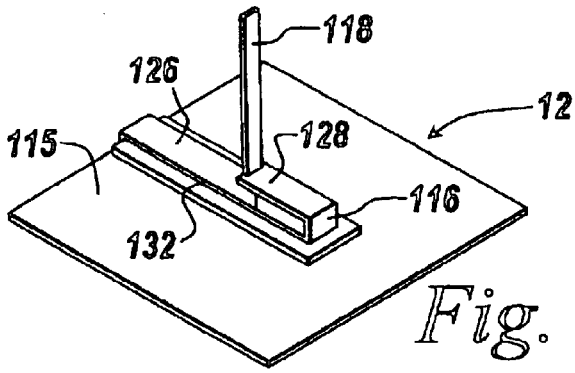
FIG. 6 is a bottom and perspective view of the antenna of FIG. 1 showing the meander line as viewed from the bottom of the top plate, with a dielectric spacer between the meander line and the top plate.
Figure 7:
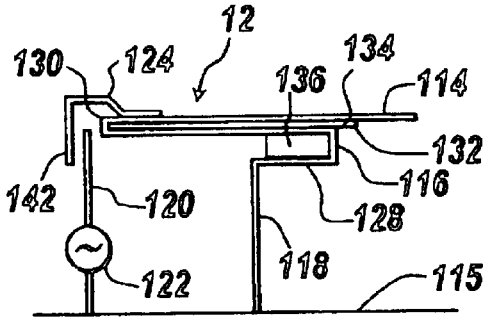
FIG. 7 is a side view of the antenna of FIG. 4 showing the capacitative coupling to the top plate, also showing a capacitative cap to increase the capacitance.

The result of so doing is to shift the low-frequency cut-off to the left in the FIG. 5, graph such that the reactance illustrated by dotted line 34, rather than being positive at lower frequencies, now goes negative as illustrated at 52, which negative reactance is subtracted from the positive reactance at peak 32. It has been found that this minimizes the VSWR and thus provides an antenna whose wideband characteristics are not altered, but whose low-frequency cut-off is lowered by as much as 30%.

Because of the use of the meander line, a compact antenna is provided which can be used in the relatively small confines of a wireless handset or, for that matter, in any place if which the low-frequency cut-off of such a compact antenna is desired.

Antenna 12 is further described in reference to FIGS. 6–9, collectively, unless otherwise stated. Antenna 12 generally includes a top plate 114, which is coupled to a ground plane plate 115 through a meander line 116 and a transmission line 118. Signals are coupled through this structure by means of a feed plate 120 connected to a signal source/receiver 122. Optionally included is a capacitance enhancing cap or plate 124.

Top plate 114 is generally rectangular or square and is substantially parallel to ground plane plate 115. Ground plane plate 115 is finite and much larger than top plate 114. The finite limitation of ground plane plate 115 allows the antenna 12 to induce currents therein and causes ground plane plate 115 to function as a radiating element.

Top plate 114 is connected to ground plane plate 115 through meander line 116 and transmission line 118. Meander line 116 is a slow wave meander line as generally described in U.S. Pat. No. 5,790,080 mentioned above.

Slow-wave meander line 116 generally includes a low impedance section 126 and a high impedance section 128. Low impedance section 126 is connected to top plate 114 at one end 130 and is mounted to top plate 114 by means of a dielectric member 132. High impedance section 128 is connected to low impedance section 126 at the other end 134 thereof, and is physically mounted to low impedance section 126 by a second dielectric member 136. In this manner, top plate 114 and the thickness and dielectric constant of each of the dielectric members 32 and 136 function to determine the impedances of sections 126 and 128.

Figure 8:
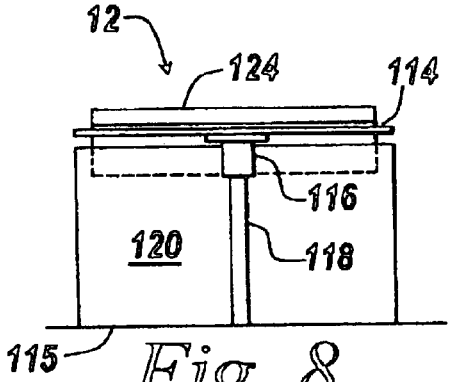
FIG. 8 is an end view of the antenna of FIG. 7 from the end opposite to the capacitive feed point.
Figure 9:
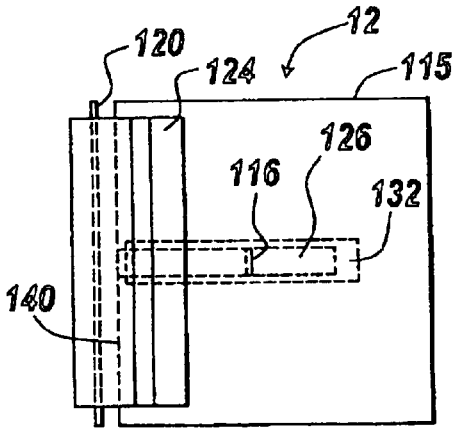
FIG. 9 is a top view of the antenna of FIG. 7 showing the placement of the meander line and the capacitive feed plate in dotted outline; and, FIG. 10 is a top view of a further embodiment of the subject invention showing a quadrature antenna which may be both vertically and circularly polarized.

Meander line 116 generally has an overall characteristic impedance equal to the square root of the product of the two impedances of sections 126 and 128. Physically, low impedance section 126 nominally extends from one end of top plate 114 for approximately three-quarters of the length of plate 114, while high impedance section 128 nominally extends for approximately one-quarter of the length of top plate 114 back to approximately the median point thereof. As shown in FIG. 8, meander line 116, as well as transmission line 118 are nominally centered along the width of top plate 114.

Transmission line 118 connects the high impedance section 128 to ground.

Further structural support may be provided to top plate 114 and meander line 116 by means of dielectric material. Such support may include a wall or other structure extending up from ground plane plate 115 or it may include a dielectric member located between top plate 114 and feed plate 120. Also, the entire antenna, including ground plane plate 115 may be located in a housing of dielectric material to which the antenna elements are attached.

Feed plate 120 is generally the same width as top plate 114 and extends along the entire edge 140 of top plate 114. Feed plate 120 is not DC connected to top plate 114, but is only located proximal thereto to provide capacitive coupling of signals to and from top plate 114.

This capacitive coupling may optionally be enhanced by the presence of a capacitance plate 124, which is connected to top plate 114. Capacitance plate 124 has an orthogonal member 142, which extends parallel to feed plate 120. The length of orthogonal member 142 is along feed plate 120 and its spacing therefrom determines the capacitance created therebetween, which capacitance may be adjusted through these characteristics.

In application, the present antenna 110, with finite ground plane plate 115 may be used as a cell phone antenna, wherein ground plane plate 115 would be oriented vertically while the phone is in use; and antenna structure 12 would extend away from the user's head. In this configuration, the present antenna generates current in the ground plane and radiates signals which are properly vertically polarized for cell phone applications; whereas, without the finite ground plane plate 115 the antenna structure might only radiate in a monopole mode at relatively low cell phone frequencies given the dimensions of antenna 12 and thereby have a signal null extending out horizontally. Inclusion of finite ground plane plate 115 enhances loop mode radiation, thereby avoiding the monopole null. In this manner a small antenna structure, relative to the applicable wavelengths, is provided for vertically polarized cell phone use, or other similarly restricted applications.

By way of example, one version of antenna 12 was constructed having a height of 0.06", and a length and width of 1.25", and it had a useful instantaneous bandwidth of 800 MHz to 6000 MHz.

Figure 10:
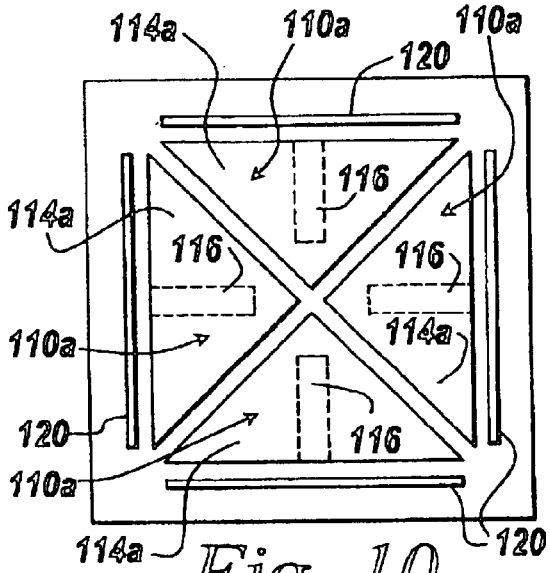

FIG. 10 shows a quadrature arrangement of antenna 12 with antenna elements 110*a*. Elements 110*a* differ from antenna 12 in that they have a top plate 114*a* which has a triangular shape so that the elements 110*a* may be arranged in quadrature. Each of elements 110*a* includes a feed plate 120, a slow-wave transmission line 116, and a transmission line to ground (not shown) which are substantially identical to those of antenna 12. Elements 110*a* are all mounted on a single ground plane plate 115*a*. By this arrangement, the elements 110*a* may be fed in quadrature by known techniques to produce circularly polarized signals.

Having now described a few embodiments of the invention, and some modifications and variations thereto, it should be apparent to those skilled in the art that the foregoing is merely illustrative and not limiting, having been presented by the way of example only. Numerous modifications and other embodiments are within the scope of one of ordinary skill in the art and are contemplated as falling within the scope of the invention as limited only by the appended claims and equivalents thereto.

What is claimed is:

1. A method for reducing the low-frequency cut-off of a wideband meander line loaded antenna comprising the step of:

providing a wideband meander line loaded antenna with a ground plane plate and a capacitive feed.

2. The method of claim 1, wherein the capacitive feed lowers the reactance of the meander line antenna such that at lower frequencies the antenna reactance goes negative to cancel out the reactance of the meander line and the associated distributed capacitance.

3. A wide bandwidth low cut-off frequency meander line loaded antenna, comprising;

a ground plane plate;

a signal source having one side connected to said ground plane plate;

a top plate spaced from said ground plane plate and having an edge;

an upstanding plate coupled at one end to the other of the sides of said signal source and having an opposed end in spaced adjacency to said end of said top plate to provide a capacitive coupling thereto; and, a meander line having one end connected to said edge of said top plate and extending in spaced adjacency along the underside of said top plate and having a looped back portion having an end connected to said ground plane plate.

4. The antenna of claim 3, and further including a capacitance increasing plate connected at one end to said edge and extending over and down said upstanding plate.

5. A wide bandwidth low cut-off frequency meander line loaded antenna having a ground plane plate and a top plate to which one end of said meander line is connected, comprising;

a signal source coupled at one end to said ground plane plate; and, a capacitance feed between said signal source and said top plate.

6. The antenna of claim 5, wherein said capacitive feed includes an auxiliary plate having one end connected to said signal source and another end in spaced adjacency to said top plate.

7. The antenna of claim 6, and further including a capacitance increasing plate having one end connected to said top plate and extending over the gap between said top plate and said auxiliary plate and running down said auxiliary plate in spaced adjacency thereto.

8. The antenna of claim 6, wherein said auxiliary plate is perpendicular to said ground plane plate.

9. The antenna of claim 6 wherein said meander line has one end connected to that portion of said top plate adjacent to said auxiliary plate.

10. The antenna of claim 9, wherein the other end of said meander line is connected to said ground plane plate.

11. The antenna of claim 5, wherein said meander line is a slow meander line.

12. The antenna of claim 11, wherein said meander line has at least two sections, each of a different impedance.

13. A method of lowering the cut-off frequency of a wideband meander line loaded antenna to be able to accommodate both the cellular band and the PCS band, comprising the step of providing the meander line loaded antenna with a ground plane plate and a capacitive feed.

14. The method of claim 13, wherein the antenna also accommodates the GPS band.

* * * * *